US007931073B2

(12) United States Patent
Gorbounov et al.

(10) Patent No.: US 7,931,073 B2
(45) Date of Patent: Apr. 26, 2011

(54) HEAT EXCHANGER WITH FLUID EXPANSION IN HEADER

(75) Inventors: Mikhail B. Gorbounov, South Windsor, CT (US); Parmesh Verma, Manchester, CT (US); Michael F. Taras, Fayetteville, NY (US); Robert A. Chopko, Baldwinsville, NY (US); Allen C. Kirkwood, Brownsburg, IN (US)

(73) Assignee: Carrier Corporation, Farmington, CT (US)

( * ) Notice: Subject to any disclaimer, the term of this patent is extended or adjusted under 35 U.S.C. 154(b) by 936 days.

(21) Appl. No.: 11/793,400

(22) PCT Filed: Dec. 28, 2005

(86) PCT No.: PCT/US2005/047360

§ 371 (c)(1),
(2), (4) Date: Jun. 18, 2007

(87) PCT Pub. No.: WO2006/083446

PCT Pub. Date: Aug. 10, 2006

(65) Prior Publication Data

US 2008/0110606 A1 May 15, 2008

Related U.S. Application Data

(60) Provisional application No. 60/649,422, filed on Feb. 2, 2005.

(51) Int. Cl.
*F28F 9/02* (2006.01)

(52) U.S. Cl. ..... 165/174; 62/527

(58) Field of Classification Search ..... None
See application file for complete search history.

(56) References Cited

U.S. PATENT DOCUMENTS

| | | | | |
|---|---|---|---|---|
| 2,297,633 | A | 9/1942 | Philipp | |
| 2,591,109 | A | 4/1952 | Wade | |
| 3,920,069 | A | 11/1975 | Mosier | |
| 4,088,182 | A | 5/1978 | Basdekas et al. | |
| 4,202,182 | A * | 5/1980 | Kawashima et al. | 62/511 |
| 4,382,468 | A | 5/1983 | Hastwell | |
| 4,497,363 | A | 2/1985 | Heronemus | |
| 4,607,689 | A | 8/1986 | Mochida et al. | |
| 4,724,904 | A | 2/1988 | Fletcher et al. | |
| 4,971,145 | A * | 11/1990 | Lyon | 165/173 |
| 5,048,602 | A * | 9/1991 | Motohashi et al. | 165/173 |

(Continued)

FOREIGN PATENT DOCUMENTS

| | | |
|---|---|---|
| CN | 1611907 | 5/2005 |

(Continued)

*Primary Examiner* — Allen J Flanigan
(74) *Attorney, Agent, or Firm* — Marjama Muldoon Blasiak & Sullivan LLP

(57) ABSTRACT

A heat exchanger includes a first header and a second header and a plurality of heat exchange tubes extending therebetween. Each heat exchange tube has an inlet end opening to one of the headers and an outlet opening to the other header. Each heat exchange tube has a plurality of channels extending longitudinally in parallel relationship from its inlet end to its outlet end, each channel defining a discrete refrigerant flow path. The inlet end of each of the plurality of heat exchange tubes is positioned with the inlet opening to the channels disposed in spaced relationship with and facing an opposite inside surface of the header thereby defining a relatively narrow gap between the inlet opening to the channels and the facing opposite inside surface of the header. The gap may function either as a primary expansion device or as a secondary expansion device.

35 Claims, 6 Drawing Sheets

U.S. PATENT DOCUMENTS

| | | | | |
|---|---|---|---|---|
| 5,318,111 | A * | 6/1994 | Young et al. | 165/150 |
| 5,320,165 | A | 6/1994 | Hughes | |
| 5,341,870 | A | 8/1994 | Hughes et al. | |
| 5,415,223 | A | 5/1995 | Reavis et al. | |
| 5,517,757 | A | 5/1996 | Hayashi et al. | |
| 5,632,329 | A | 5/1997 | Fay | |
| 5,743,329 | A * | 4/1998 | Damsohn et al. | 165/174 |
| 5,826,649 | A | 10/1998 | Chapp et al. | |
| 5,934,367 | A | 8/1999 | Shimmura et al. | |
| 5,941,303 | A | 8/1999 | Gowan et al. | |
| 5,967,228 | A | 10/1999 | Bergman et al. | |
| 5,971,065 | A | 10/1999 | Bertilson et al. | |
| 6,073,686 | A * | 6/2000 | Park et al. | 165/144 |
| 6,340,055 | B1 | 1/2002 | Yamauchi et al. | |
| 6,446,713 | B1 * | 9/2002 | Insalaco | 165/173 |
| 6,546,998 | B2 | 4/2003 | Oh et al. | |
| 6,564,863 | B1 * | 5/2003 | Martins | 165/175 |
| 6,688,137 | B1 | 2/2004 | Gupte | |
| 6,688,138 | B2 | 2/2004 | DiFlora | |
| 7,044,208 | B2 * | 5/2006 | Kawakubo et al. | 165/173 |
| 2001/0004935 | A1 | 6/2001 | Sanada et al. | |
| 2003/0116308 | A1 | 6/2003 | Watanabe et al. | |
| 2003/0155109 | A1 | 8/2003 | Kawakubo et al. | |
| 2004/0211551 | A1 * | 10/2004 | Shinmura et al. | 165/175 |

FOREIGN PATENT DOCUMENTS

| | | |
|---|---|---|
| EP | 0228330 | 7/1987 |
| FR | 1258044 | 2/1961 |
| JP | 2217764 | 8/1990 |
| JP | 02217764 A * | 8/1990 |
| JP | 4080575 | 3/1992 |
| JP | 6241682 | 9/1994 |
| JP | 7301472 | 11/1995 |
| JP | 8233409 | 9/1996 |
| JP | 11351706 | 12/1999 |
| JP | 2002022313 | 1/2002 |
| WO | WO-0242707 | 5/2002 |

* cited by examiner

HEAT EXCHANGER WITH FLUID EXPANSION IN HEADER

CROSS-REFERENCE TO RELATED APPLICATION

Reference is made to and this application claims priority from and the benefit of U.S. Provisional Application Ser. No. 60/649,422, filed Feb. 2, 2005, and entitled MINI-CHANNEL HEAT EXCHANGER WITH FLUID EXPANSION IN A GAP BETWEEN THE TUBE AND THE HEADER, which application is incorporated herein in its entirety by reference

FIELD OF THE INVENTION

This invention relates generally to refrigerant vapor compression system heat exchangers having a plurality of parallel tubes extending between a first header and a second header and, more particularly, to providing expansion of refrigerant within the inlet header for improving distribution of two-phase refrigerant flow through the parallel tubes of the heat exchanger.

BACKGROUND OF THE INVENTION

Refrigerant vapor compression systems are well known in the art. Air conditioners and heat pumps employing refrigerant vapor compression cycles are commonly used for cooling or cooling/heating air supplied to a climate controlled comfort zone within a residence, office building, hospital, school, restaurant or other facility. Refrigerant vapor compression systems are also commonly used for cooling air, or other secondary media such as water or glycol solution, to provide a refrigerated environment for food items and beverage products with display cases in supermarkets, convenience stores, groceries, cafeterias, restaurants and other food service establishments.

Conventionally, these refrigerant vapor compression systems include a compressor, a condenser, an expansion device, and an evaporator connected in refrigerant flow communication. The aforementioned basic refrigerant system components are interconnected by refrigerant lines in a closed refrigerant circuit and arranged in accord with the vapor compression cycle employed. An expansion device, commonly an expansion valve or a fixed-bore metering device, such as an orifice or a capillary tube, is disposed in the refrigerant line at a location in the refrigerant circuit upstream with respect to refrigerant flow of the evaporator and downstream of the condenser. The expansion device operates to expand the liquid refrigerant passing through the refrigerant line running from the condenser to the evaporator to a lower pressure and temperature. In doing so, a portion of the liquid refrigerant traversing the expansion device expands to vapor. As a result, in conventional refrigerant vapor compression systems of this type, the refrigerant flow entering the evaporator constitutes a two-phase mixture. The particular percentages of liquid refrigerant and vapor refrigerant depend upon the particular expansion device employed, operating conditions, and the refrigerant in use, for example R-12, R-22, R-134a, R-404A, R-410A, R-407C, R717, R744 or other compressible fluid.

In some refrigerant vapor compression systems, the evaporator is a parallel tube heat exchanger. Such heat exchangers have a plurality of parallel refrigerant flow paths therethrough provided by a plurality of tubes extending in parallel relationship between an inlet header or inlet manifold and an outlet header or outlet manifold. The inlet header receives the refrigerant flow from the refrigerant circuit and distributes the refrigerant flow amongst the plurality of flow paths through the heat exchanger. The outlet header serves to collect the refrigerant flow as it leaves the respective flow paths and to direct the collected flow back to the refrigerant line for return to the compressor in a single pass heat exchanger or to an additional bank of heat exchange tubes in a multi-pass heat exchanger. In the latter case, the outlet header is an intermediate manifold or a manifold chamber and serves as an inlet header to the next downstream bank of tubes.

Historically, parallel tube heat exchangers used in such refrigerant vapor compression systems have used round tubes, typically having a diameter of ⅜ inch or 7 millimeters. More recently, flat, typically rectangular or oval in cross-section, multi-channel tubes are being used in heat exchangers for refrigerant vapor compression systems. Each multi-channel tube quite often has a plurality of flow channels extending longitudinally in parallel relationship the length of the tube, each channel providing a relatively small flow area refrigerant flow path. Thus, a heat exchanger with multi-channel tubes extending in parallel relationship between the inlet and outlet headers of the heat exchanger will have a relatively large number of small flow area refrigerant flow paths extending between the two headers. In contrast, a conventional heat exchanger with conventional round tubes will have a relatively small number of large flow area flow paths extending between the inlet and outlet headers.

Non-uniform distribution, also referred to as maldistribution, of two-phase refrigerant flow is a common problem in parallel tube heat exchangers which adversely impacts heat exchanger efficiency. Two-phase maldistribution problems are often caused by the difference in density of the vapor phase refrigerant and the liquid phase refrigerant present in the inlet header due to the expansion of the refrigerant as it traversed the upstream expansion device.

One solution to control refrigeration flow distribution through parallel tubes in an evaporative heat exchanger is disclosed in U.S. Pat. No. 6,502,413, Repice et al. In the refrigerant vapor compression system disclosed therein, the high pressure liquid refrigerant from the condenser is partially expanded in a conventional in-line expansion valve upstream of the evaporative heat exchanger inlet header to a lower pressure, liquid refrigerant. A restriction, such as a simple narrowing in the tube or an internal orifice plate disposed within the tube, is provided in each tube connected to the inlet header downstream of the tube inlet to complete expansion to a low pressure, liquid/vapor refrigerant mixture after entering the tube.

Another solution to control refrigerant flow distribution through parallel tubes in an evaporative heat exchanger is disclosed in Japanese Patent No. JP4080575, Kanzaki et al. In the refrigerant vapor compression system disclosed therein, the high pressure liquid refrigerant from the condenser is also partially expanded in a conventional in-line expansion valve to a lower pressure, liquid refrigerant upstream of a distribution chamber of the heat exchanger. A plate having a plurality of orifices therein extends across the chamber. The lower pressure liquid refrigerant expands as it passes through the orifices to a low pressure liquid/vapor mixture downstream of the plate and upstream of the inlets to the respective tubes opening to the chamber.

Japanese Patent No. 6241682, Massaki et al., discloses a parallel flow tube heat exchanger for a heat pump wherein the inlet end of each multi-channel tube connecting to the inlet header is crushed to form a partial throttle restriction in each tube just downstream of the tube inlet. Japanese Patent No. JP8233409, Hiroaki et al., discloses a parallel flow tube heat exchanger wherein a plurality of flat, multi-channel tubes connect between a pair of headers, each of which has an interior which decreases in flow area in the direction of refrigerant flow as a means to uniformly distribute refrigerant to the respective tubes. Japanese Patent No. JP2002022313, Yasushi, discloses a parallel tube heat exchanger wherein refrigerant is supplied to the header through an inlet tube that extends long the axis of the header to terminate short of the end of the header whereby the two phase refrigerant flow does not separate as it passes from the inlet tube into an annular channel between the outer surface of the inlet tube and the inside surface of the header. The two-phase refrigerant flow thence passes into each of the tubes opening to the annular channel.

Obtaining uniform refrigerant flow distribution amongst the relatively large number of small flow area refrigerant flow paths is even more difficult than it is in conventional round tube heat exchangers and can significantly reduce heat exchanger efficiency as well as cause serious reliability problems due to compressor flooding.

SUMMARY OF THE INVENTION

It is a general object of the invention to reduce maldistribution of refrigerant flow in a refrigerant vapor compression system heat exchanger having a plurality of multi-channel tubes extending between a first header and a second header.

It is an object of one aspect of the invention to distribute refrigerant to the individual channels of an array of multi-channel tubes in a single phase as liquid refrigerant.

It is an object of another aspect of the invention to delay expansion of the refrigerant in a refrigerant vapor compression system heat exchanger having a plurality of multi-channel tubes until after the refrigerant flow has been distributed to the individual channels of an array of multi-channel tubes in a single phase as liquid refrigerant.

In one aspect of the invention, a heat exchanger is provided having a header defining a chamber for receiving predominantly liquid refrigerant from a refrigerant circuit, and at least one heat exchange tube defining a refrigerant flow path therethrough and having an inlet opening to said refrigerant flow path at an inlet end thereof. The inlet end of the heat exchange tube extends into the chamber of the header and is positioned with the inlet opening to the refrigerant flow path disposed in spaced relationship with and facing the inside surface of the header thereby defining a relatively narrow gap between the inlet opening to the refrigerant flow path of the heat exchange tube and the facing inside surface of the header. The gap may have a breadth in the range of 0.01-0.5 millimeter. In one embodiment, the gap has a breadth on the order of 0.1 millimeter. In an embodiment of the heat exchanger, at least one heat exchange tube has a plurality of channels extending longitudinally in parallel relationship through the refrigerant flow path thereof, each channel defining a discrete refrigerant flow path through the at least one heat exchange tube. The flow paths defined by the plurality of channels may have a circular cross-section, a rectangular cross-section, a triangular cross-section, a trapezoidal cross-section or other non-circular cross-section. The heat exchanger of the invention may be embodied in single-pass or multiple-pass arrangements.

In a particular embodiment, the heat exchanger has a first header, a second header, and a plurality of heat exchange tubes extending between the first and second headers. Each header defines a chamber for collecting refrigerant. Each tube of the plurality of heat exchange tubes has an inlet end opening to the chamber of one of the headers and an outlet end opening to the other of the headers. Each tube of the plurality of heat exchange tubes has a plurality of channels extending longitudinally in parallel relationship from the inlet end to the outlet end thereof, with each channel defining a discrete refrigerant flow path. The inlet end of each heat exchange tube extends into the chamber of at least one of the headers and is positioned with the inlet opening to the channels disposed in spaced relationship with and facing the inside surface, of the header thereby defining relatively narrow gap between the inlet opening to the channels and the facing inside surface of the header.

In another aspect of the invention, a refrigerant vapor compression system includes a compressor, a condenser and an evaporative heat exchanger connected in refrigerant flow communication whereby high pressure refrigerant vapor passes from the compressor to the condenser, high pressure refrigerant liquid passes from the condenser to the evaporative heat exchanger, and low pressure refrigerant vapor passes from the evaporative heat exchanger to the compressor. The evaporative heat exchanger includes at least an inlet header and an outlet header, and at least one heat exchange tube extending between the inlet and outlet headers. The inlet header defines a chamber for receiving liquid refrigerant from a refrigerant circuit. Each heat exchange tube has an inlet end opening to the chamber of the inlet header and an outlet end opening to the outlet header. Each tube heat exchange tube has a plurality of channels extending longitudinally in parallel relationship from the inlet end to the outlet end thereof, with each channel defining a discrete refrigerant flow path. The inlet end of each heat exchange tube extends into the chamber of the inlet header and is positioned with the inlet opening to the channels disposed in spaced relationship with and facing the inside surface of the header thereby defining an expansion gap between the inlet opening to the channels and the facing inside surface of the inlet header. In a refrigerant vapor compression system incorporating a heat exchanger in accordance with the invention as the evaporator, the expansion may be utilized as the only expansion device in the system or a primary expansion device or secondary expansion device in series with an upstream expansion device in the refrigerant line leading to the evaporator of the system.

In a further aspect of the invention, a method is provided for operating a refrigerant vapor compression cycle. The method includes the steps of: providing a compressor, a condenser, and an evaporative heat exchanger connected in a refrigerant circuit; passing high pressure refrigerant vapor from the compressor to the condenser; passing high pressure refrigerant liquid from the condenser to an inlet header of the evaporative heat exchanger; providing at least one heat exchange tube defining a plurality of refrigerant flow paths for passing refrigerant from the inlet header to an outlet header of the evaporative heat exchanger; distributing the high pressure liquid received in the inlet header to and through each of the plurality of refrigerant flow paths by passing the high pressure liquid refrigerant through an expansion gap formed between an inside surface of the inlet header and an inlet to the at least one heat exchange tube, whereby the liquid refrigerant is substantially uniformly distributed to the plurality of refrigerant flow paths and is expanded to a low pressure mixture of liquid refrigerant and vapor refrigerant; and passing the low pressure refrigerant vapor from the outlet header of the evaporative heat exchanger back to the compressor.

BRIEF DESCRIPTION OF THE DRAWINGS

For a further understanding of these and other objects of the invention, reference will be made to the following detailed description of the invention which is to be read in connection with the accompanying drawing, where.

DETAILED DESCRIPTION OF THE INVENTION

Figure 1:
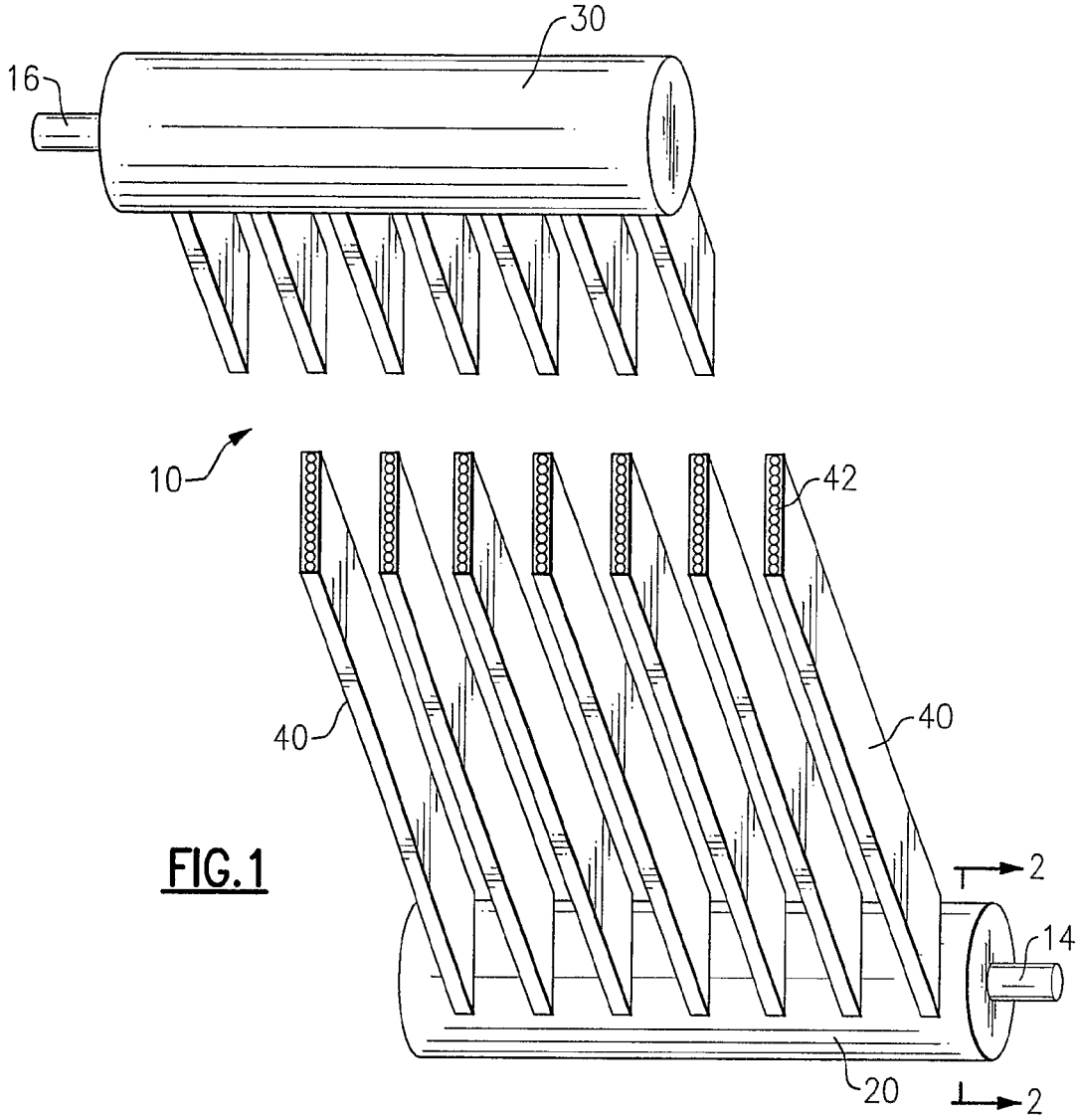
FIG. 1 is a perspective view of an embodiment of a heat exchanger in accordance with the invention.

The parallel tube heat exchanger 10 of the invention will be described herein in general with reference to the various illustrative single pass embodiments of a multi-channel tube heat exchanger as depicted in FIGS. 1-8. The heat exchanger 10 includes an inlet header 20, an outlet header 30, and a plurality of multi-channel heat exchange tubes 40 extending longitudinally between the inlet header 20 and the outlet header 30 thereby providing a plurality of refrigerant flow paths between the inlet header 20 and the outlet header 30. Each heat exchange tube 40 has an inlet 43 at one end in refrigerant flow communication to the inlet header 20 and an outlet at its other end in refrigerant flow communication to the outlet header 30.

In the illustrative embodiments of the heat exchanger 10 depicted in FIGS. 1, 3, 5 and 7, the heat exchange tubes 40 are shown arranged in parallel relationship extending generally vertically between a generally horizontally extending inlet header 20 and a generally horizontally extending outlet header 30. However, the depicted embodiments are illustrative and not limiting of the invention. It is to be understood that the invention described herein may be practiced on various other configurations of the heat exchanger 10. For example, the heat exchange tubes may be arranged in parallel relationship extending generally horizontally between a generally vertically extending inlet header and a generally vertically extending outlet header. As a further example, the heat exchanger could have a toroidal inlet header and a toroidal outlet header of a different diameter with the heat exchange tubes extend either somewhat radially inwardly or somewhat radially outwardly between the toroidal headers. The heat exchange tubes may also be arranged in multi-pass embodiments, as will be discussed in further detail later herein.

Each multi-channel heat exchange tube 40 has a plurality of parallel flow channels 42 extending longitudinally, i.e. along the axis of the tube, the length of the tube thereby providing multiple, independent, parallel flow paths between the inlet and the outlet of the tube. Each multi-channel heat exchange tube 40 is a "flat" tube of, for example, rectangular cross-section defining an interior which is subdivided to form a side-by-side array of independent flow channels 42. The flat, multi-channel tubes 40 may have, for example, a width of fifty millimeters or less, typically twelve to twenty-five millimeters, and a height of about two millimeters or less, as compared to conventional prior art round tubes having a diameter of ½ inch, ⅜ inch or 7 mm. The tubes 40 are shown in FIGS. 1-8, for ease and clarity of illustration, as having twelve channels 42 defining flow paths having a circular cross-section. However, it is to be understood that in applications, each multi-channel tube 40 will typically have about ten to twenty flow channels 42. Generally, each flow channel 42 will have a hydraulic diameter, defined as four times the cross-sectional flow area divided by the perimeter, in the range from about 200 microns to about 3 millimeters. Although depicted as having a circular cross-section in the drawings, the channels 42 may have a rectangular, triangular or trapezoidal cross-section, or any other desired non-circular cross-section.

Referring now to FIGS. 2, 4, 6 and 8, in particular, each heat exchange tube 40 of the heat exchanger 10 are inserted into one side of the inlet header 20 with the inlet end 43 of the tube extending into the interior 25 of inlet header 20. Each heat exchange tube 40 is inserted for sufficient length to juxtapose the respective mouths 41 of the channels 42 at the inlet end 43 of the heat exchange tube 40 in closely adjacent relationship with the inside surface 22 of the opposite side of the header 20 so as to provide a relatively narrow gap, G, between the mouths 41 at the inlet end 43 of the heat exchange tube 40 and the inside surface 22 of the header 20. The gap, G, must be small enough in relation to the flow area at the mouth 41 of each of the channels 42 of the heat exchange tube 40 to ensure that the desired level of expansion of the high pressure liquid refrigerant to a low pressure liquid and vapor refrigerant mixture occurs as the refrigerant flows through the gap, G, to enter the mouth 41 of each channel 42. Typically, the gap, G, would have a breadth, as measured from the mouth 41 of the inlet end 43 of the tube 40 to the facing inside surface of the header, on the order of a tenth of a millimeter (0.1 millimeters) for a heat exchange tube 40 having channels with a nominal 1 square millimeter internal flow cross-section area. Of course, as those skilled in the art will recognize, the degree of expansion can be adjusted by selectively positioning the inlet end of the tube 40 relative to the inside surface 22 of the header 20 to change the breadth of the gap, G.

Figure 2:
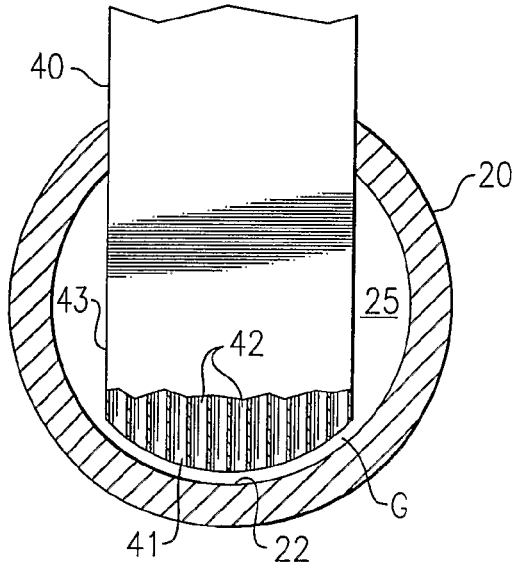
FIG. 2 is a sectioned view taken along line 2-2 of FIG. 1.
Figure 3:
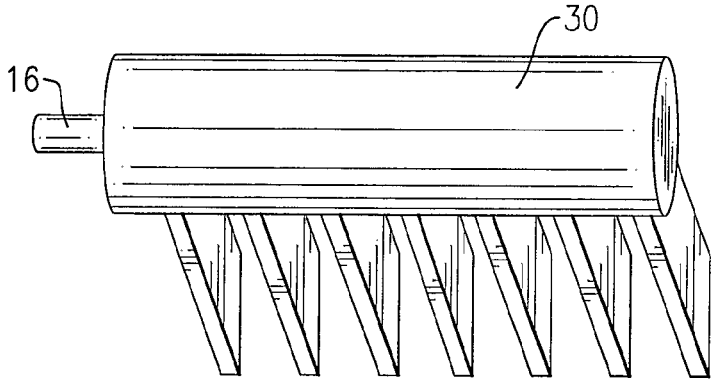
FIG. 3 is a perspective view of an another embodiment of the heat exchanger tube and inlet header arrangement.
Figure 3:
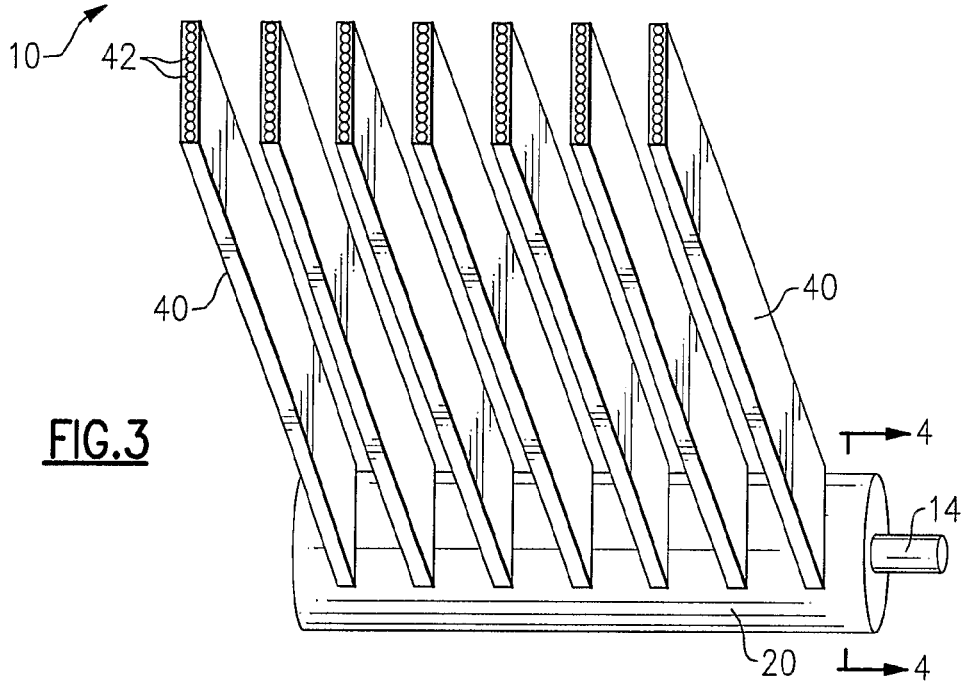
Figure 4:
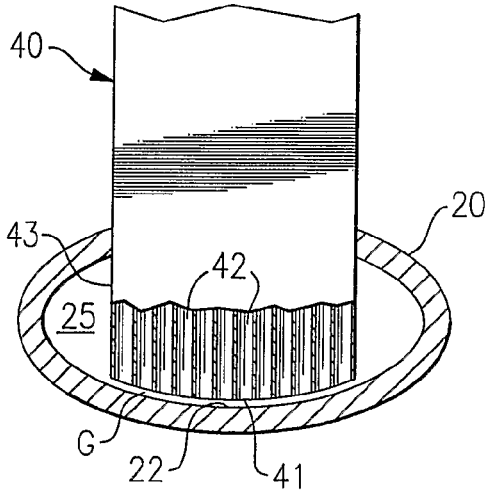
FIG. 4 is a sectioned view taken along line 4-4 of FIG. 3.
Figure 5:
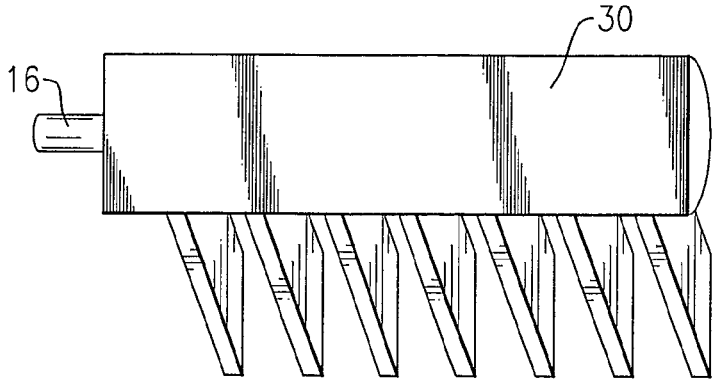
FIG. 5 is a perspective view of an another embodiment of the heat exchanger tube and inlet header arrangement.
Figure 5:
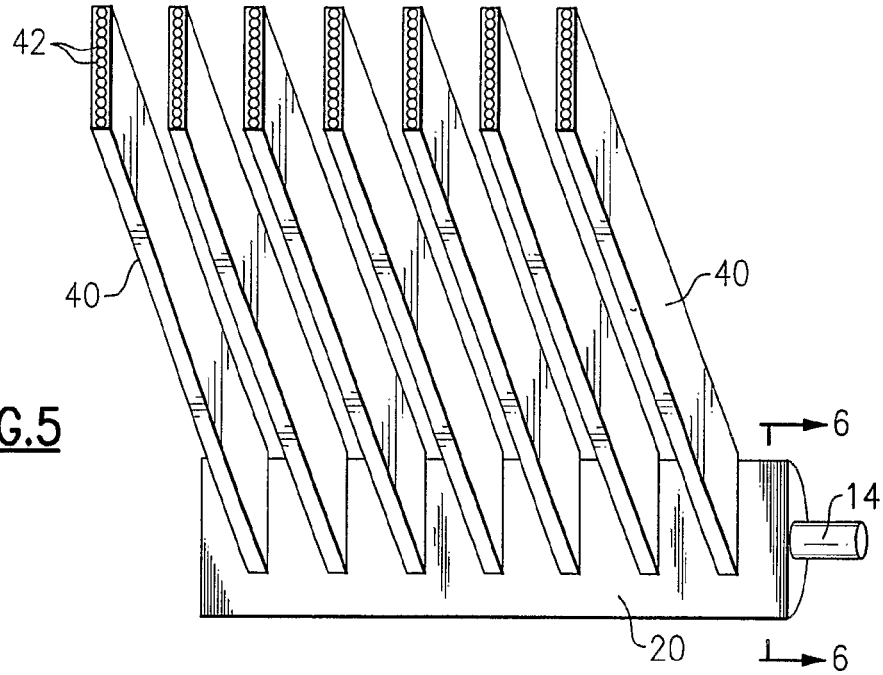
Figure 6:
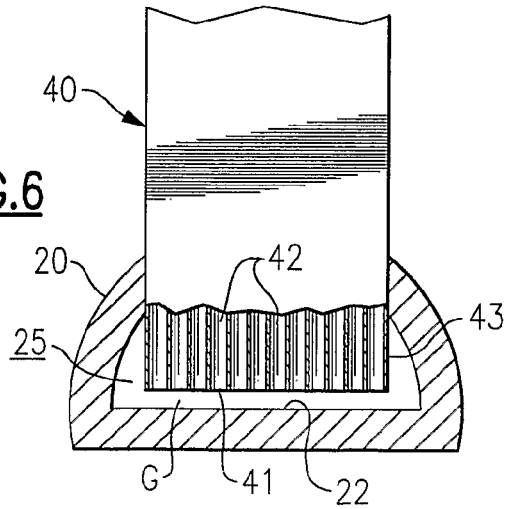
FIG. 6 is a sectioned view taken along line 6-6 of FIG. 5.
Figure 7:
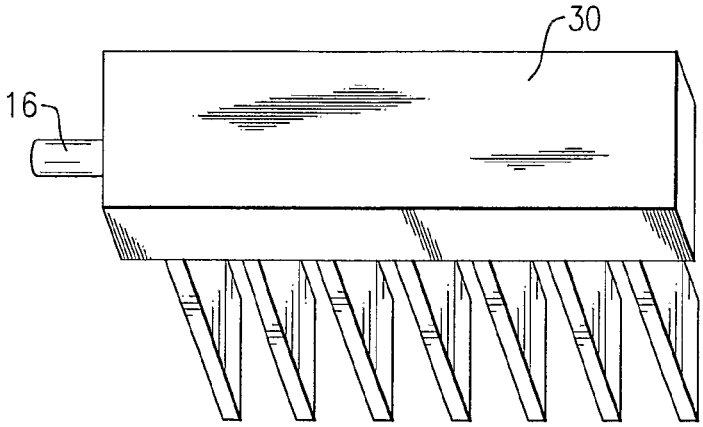
FIG. 7 is a perspective view of an another embodiment of the heat exchanger tube and inlet header arrangement.
Figure 7:
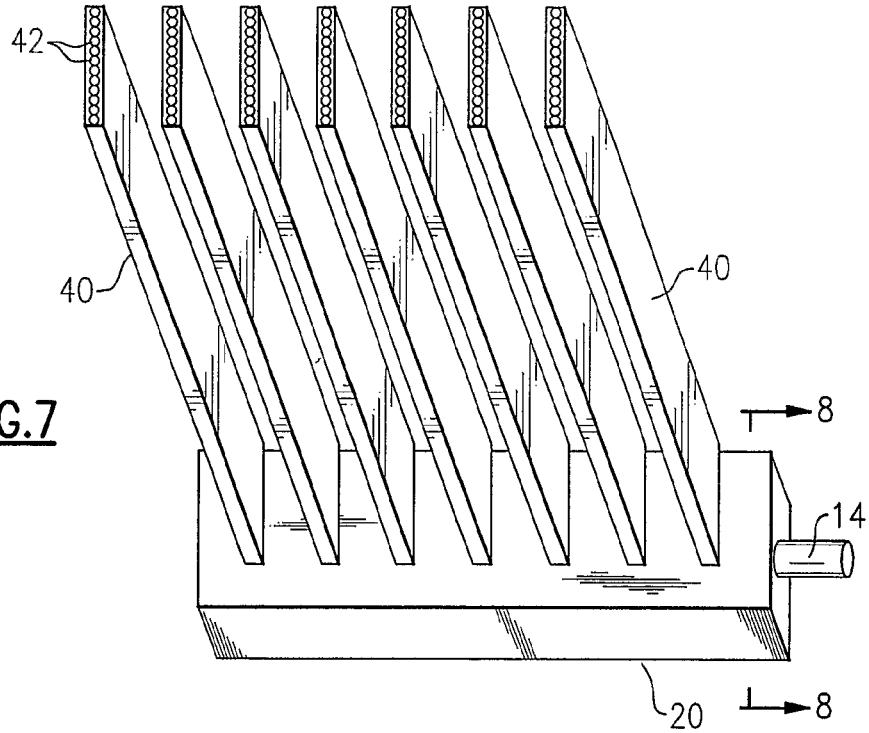
Figure 8:
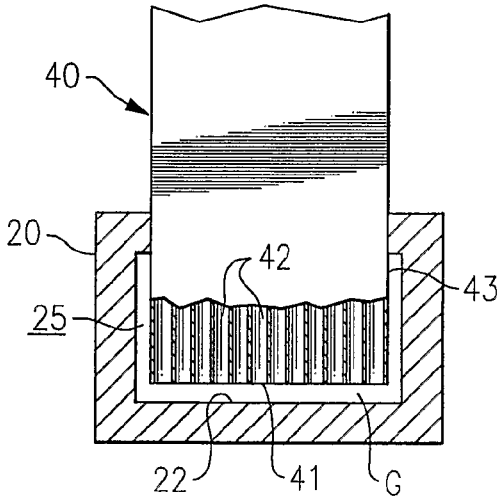
FIG. 8 is a sectioned view taken along line 8-8 of FIG. 7.

In the embodiment depicted in FIGS. 1 and 2, the headers 20 and 30 comprise longitudinally elongated, hollow, closed end cylinders having a circular cross-section. In the embodiment depicted in FIGS. 3 and 4, the headers 20 and 30 comprise longitudinally elongated, hollow, closed end cylinders having an elliptical cross-section. In the embodiment depicted in FIGS. 5 and 6, the headers 20 and 30 comprises longitudinally elongated, hollow, closed end vessel having a D-shaped cross-section. In the embodiment depicted in FIGS. 7 and 8, the headers 20 and 30 comprise longitudinally elongated, hollow, closed end vessels having a rectangular shaped cross-section. In each embodiment, the high pressure, liquid refrigerant that enters the inlet header 20 through the refrigerant line 14 flows along the interior 25 of the header 20 and self-distributes, due to its uniform density and high pressure, amongst each of the heat transfer tubes 40 and expands as it passes through the gaps, G, between the respective mouths 41 of the channels 42 and the inside surface 22 of the header 20, to enter the mouth of each channel.

Figure 9:
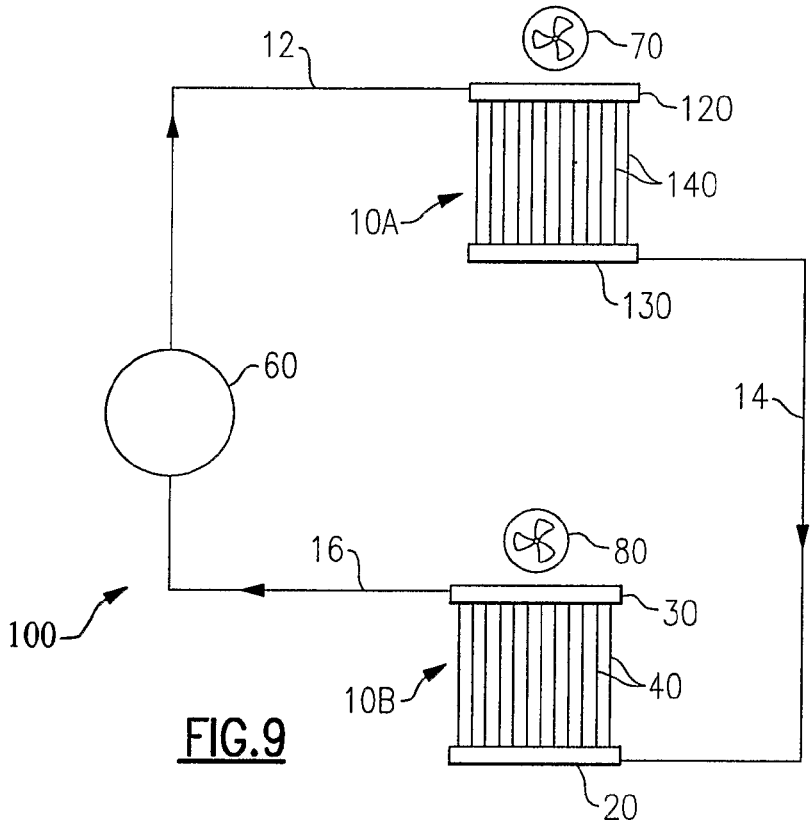
FIG. 9 is a schematic illustration of a refrigerant vapor compression system incorporating the heat exchanger of the invention.
Figure 10:
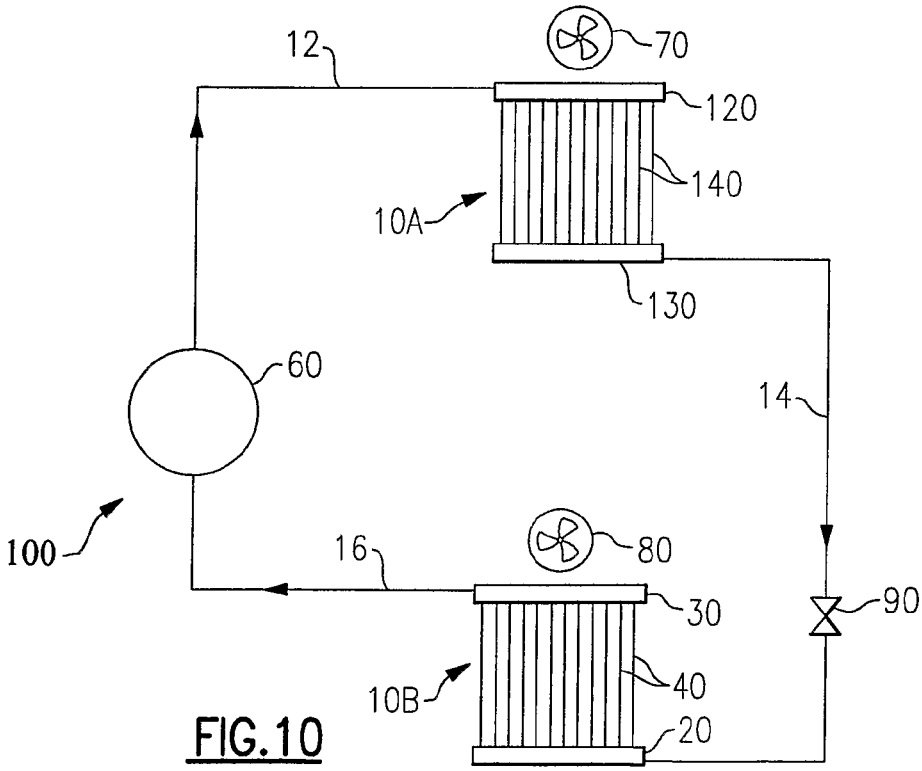
FIG. 10 is a schematic illustration of a refrigerant vapor compression system incorporating the heat exchanger of the invention.

Referring now to FIGS. 9 and 10, there is depicted schematically a refrigerant vapor compression system 100 including a compressor 60, the heat exchanger 10A, functioning as a condenser, and the heat exchanger 10B, functioning as an evaporator, connected in a closed loop refrigerant circuit by refrigerant lines 12, 14 and 16. As in conventional refrigerant vapor compression systems, the compressor 60 circulates hot, high pressure refrigerant vapor through refrigerant line 12 into the inlet header 120 of the condenser 10A, and thence through the heat exchanger tubes 140 of the condenser 10A wherein the hot refrigerant vapor condenses to a liquid as it passes in heat exchange relationship with a cooling fluid, such as ambient air which is passed over the heat exchange tubes 140 by the condenser fan 70. The high pressure, liquid refrigerant collects in the outlet header 130 of the condenser 10A and thence passes through refrigerant line 14 to the inlet header 20 of the evaporator 10B. The refrigerant thence passes through the heat exchanger tubes 40 of the evaporator 10B wherein the refrigerant is heated as it passes in heat exchange relationship with air to be cooled which is passed over the heat exchange tubes 40 by the evaporator fan 80. The refrigerant vapor collects in the outlet header 30 of the evaporator 10B and passes therefrom through refrigerant line 16 to return to the compressor 60 through the suction inlet thereto. Although the exemplary refrigerant vapor compression cycles illustrated in FIGS. 9 and 10 are simplified air conditioning cycles, it is to be understood that the heat exchanger of the invention may be employed in refrigerant vapor compression systems of various designs, including, without limitation, heat pump cycles, economized cycles, cycles with tandem components such as compressors and heat exchangers, chiller cycles and many other cycles including various options and features.

In the embodiment depicted in FIG. 9, the condensed refrigerant liquid passes from the condenser 10A directly to the evaporator 10B without traversing an expansion device. Thus, in this embodiment, the refrigerant enters the inlet header 20 of the evaporative heat exchanger 10B as a high pressure, liquid refrigerant, not as a fully expanded, low pressure, refrigerant liquid/vapor mixture, as in conventional refrigerant vapor compression systems. Thus, in this embodiment, expansion of the refrigerant occurs within the evaporator 10B of the invention at the gap, G, thereby ensuring that expansion occurs only after distribution has been achieved in a substantially uniform manner.

In the embodiment depicted in FIG. 10, the condensed refrigerant liquid passes through an expansion device 90 operatively associated with the refrigerant line 14 as it passes from the condenser 10A to the evaporator 10B. In the expansion device 90, the high pressure, liquid refrigerant is partially expanded to lower pressure, liquid refrigerant or a liquid/vapor refrigerant mixture. In this embodiment, the expansion of the refrigerant is completed within the evaporator 10B of the invention at the gap, G. Partial expansion of the refrigerant in an expansion device 90 upstream of the inlet header 20 of the evaporator 10B may be advantageous when the gap, G, can not be made small enough to ensure complete expansion as the liquid passes through the gap, G, or when a thermostatic expansion valve or electronic expansion valve 90 is used as a flow control device.

Figure 11:
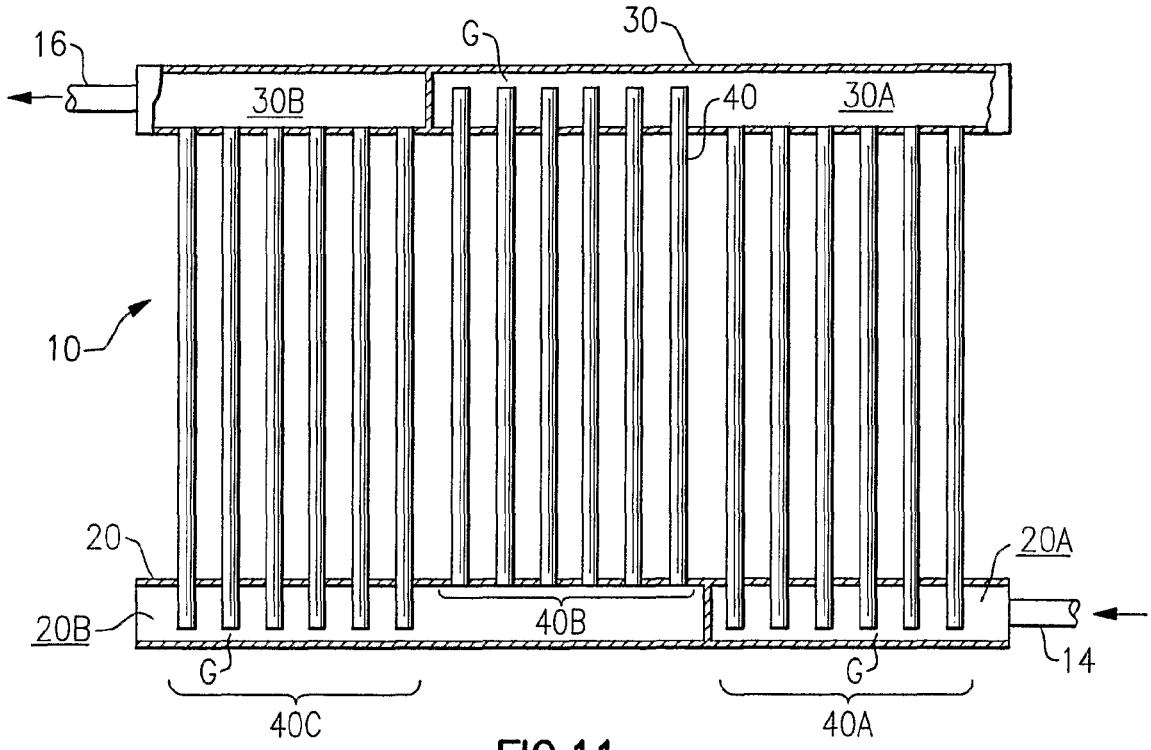
FIG. 11 is an elevation view, partly in section, of an embodiment of a multi-pass evaporator in accordance with the invention.

The embodiments of the heat exchanger of the invention illustrated in FIGS. 1, 3, 5 and 7 are depicted as single pass heat exchangers. However, the heat exchanger of the invention may also be a multi-pass heat exchanger. Referring now to FIG. 11, the heat exchanger 10 is depicted in a multi-pass, evaporator embodiment. In the illustrated multi-pass embodiment, the inlet header is partitioned into a first chamber 20A and a second chamber 20B, the outlet header is also partitioned into a first chamber 30A and a second chamber 30B, and the heat exchange tubes 40 are divided into three banks 40A, 40B and 40C. The heat exchange tubes of the first tube bank 40A have inlets opening into the first chamber 20A of the inlet header 20 and outlets opening to the first chamber 30A of the outlet header 30. The heat exchange tubes of the second tube bank 40B have inlets opening into the first chamber 30A of the outlet header 30 and outlets opening to the second chamber 20B of the inlet header 20. The heat exchange tubes of the third tube bank 40C have inlets opening into the second chamber 20B of the inlet header 20 and outlets opening to the second chamber 30B of the outlet header 30. In this manner, refrigerant entering the heat exchanger from refrigerant line 14 passes in heat exchange relationship with air passing over the exterior of the heat exchange tubes 40 three times, rather than once as in a single-pass heat exchanger. In accord with the invention, the inlet end of each of the heat exchange tubes of the first, second and third tube banks is positioned within its associated header chamber with the inlet openings to the multiple flow channels thereof disposed in spaced relationship with and facing the opposite inside surface of the respective header so as to define an expansion gap, G, between the inlet opening to the channels and the opposite inside surface of the respective header. Thus, expansion also occurs in the headers between passes, thereby ensuring more uniform distribution of the refrigerant liquid/vapor upon entering the flow channels of the tubes of each tube pass.

Refrigerant, either as a high pressure liquid, or a partially expanded liquid/vapor mixture, passes from refrigerant line 14 into the first chamber 20A of the header 20 of the heat exchanger 10. The refrigerant thence passes from the chamber 20A through the gap, G, into each of the flow channels 42 associated with the heat exchange tubes of the first tube bank 40A, which constitutes the right-most four tubes depicted in FIG. 11. As the refrigerant passes through the gap, G, the refrigerant expands as discussed hereinbefore. The refrigerant liquid/vapor mixture passes from the flow channels of the first tube bank 40A into the first chamber 30A of the outlet header 30 and is distributed therefrom into the heat exchange tubes of the second tube bank 40B, which constitutes the central four tubes depicted in FIG. 11. To enter the flow channels of the heat exchange tubes of the second tube bank 40B from the first chamber 30A of the outlet header 30, the refrigerant must again pass through a narrow gap, G, resulting in further expansion of the refrigerant. The refrigerant liquid/vapor mixture passes from the flow channels of the second tube bank 40B into the second chamber 20B of the inlet header 20 and is distributed therefrom into the heat exchange tubes of the third tube bank 40C, which constitutes the left-most four tubes depicted in FIG. 11. To enter the flow channels of the heat exchange tubes of the third tube bank 40C from the second chamber 20B of the inlet header 20B, the refrigerant must again pass through a narrow gap, G, resulting in further expansion of the refrigerant. The refrigerant liquid/vapor mixture passes from the flow channels of the third tube bank 40C into the second chamber 30B of the outlet header 30 and passes therefrom into the refrigerant line 16.

Figure 12:
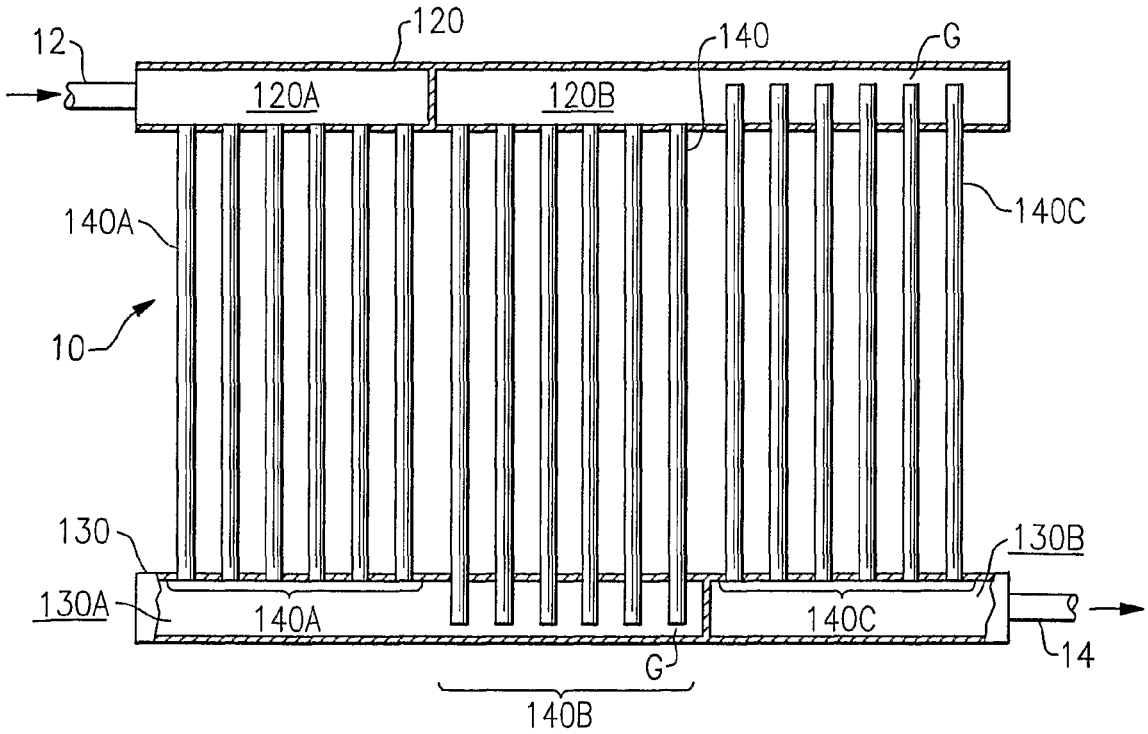
FIG. 12 is an elevation view, partly in section, of an embodiment of a multi-pass condenser in accordance with the invention.

Referring now to FIG. 12, the heat exchanger 10 is depicted in a multi-pass, condenser embodiment. In the illustrated multi-pass embodiment, the inlet header 120 is partitioned into a first chamber 120A and a second chamber 120B, the outlet header 130 is also partitioned into a first chamber 130A and a second chamber 130B, and the heat exchange tubes 140 are divided into three tube banks 140A, 140B and 140C. The heat exchange tubes of the first tube bank 140A have inlets opening into the first chamber 120A of the inlet header 120 and outlets opening to the first chamber 130A of the outlet header 130. The heat exchange tubes of the second tube bank 140B have inlets opening into the first chamber 130A of the outlet header 130 and outlets opening to the second chamber 120B of the inlet header 120. The heat exchange tubes of the third tube bank 140C have inlets opening into the second chamber 120B of the inlet header 120 and outlets opening to the second chamber 130B of the outlet header 130. In this manner, refrigerant entering the condenser from refrigerant line 12 passes in heat exchange relationship with air passing over the exterior of the heat exchange tubes 140 three times, rather than once as in a single-pass heat exchanger. The refrigerant entering the first chamber 120A of the inlet header 120 is entirely high pressure, refrigerant vapor directed from the compressor outlet via refrigerant line 14. However, the refrigerant entering the second tube bank and the third tube bank will be a liquid/vapor mixture as refrigerant partially condenses in passing through the first and second tube banks. In accord with the invention, the inlet end of each of the heat exchange tubes of the second and third tube banks is positioned within its associated header chamber with the inlet opening to the multiple flow channels thereof disposed in spaced relationship with and facing the opposite inside surface of the respective header so as to define a relatively narrow gap, G, between the inlet opening to the channels and the opposite inside surface of the respective header. The gap, G, provides a flow restriction that ensures more uniform distribution of the refrigerant liquid/vapor mixture upon entering the flow channels of the heat exchange tubes of each subsequent pass.

Hot, high pressure refrigerant vapor from the compressor 60 passes from refrigerant line 12 into the first chamber 120A of inlet header 120 of the heat exchanger 10. The refrigerant thence passes from the chamber 120A into each of the flow channels 42 associated with the heat exchange tubes of the first tube bank 140A, which constitutes the left-most four tubes depicted in FIG. 12. As the refrigerant passes through the flow channels of the first tube bank 140A, a portion of the refrigerant vapor condenses into a liquid. The refrigerant liquid/vapor mixture passes from the flow channels of the first tube bank 140A into the first chamber 130A of the outlet header 130 and is distributed therefrom into the tubes of the second tube bank 140B, which constitutes the central four tubes depicted in FIG. 12. To enter the flow channels of the heat exchange tubes of the second tube bank 140B from the first chamber 130A of the outlet header 130, the refrigerant liquid/vapor must now pass through a narrow gap, G. The refrigerant liquid/vapor mixture passes from the flow channels of the second tube bank 140B into the second chamber 120B of the inlet header 120 and is distributed therefrom into the tubes of the third tube bank 140C, which constitutes the right-most four tubes depicted in FIG. 12. To enter the flow channels of the heat exchange tubes of the third tube bank 140C from the second chamber 120B of the inlet header 120, the refrigerant must again pass through a narrow gap, G. The refrigerant liquid/vapor mixture passes from the flow channels of the third tube bank 140C into the second chamber 130B of the outlet header 130 and passes therefrom into the refrigerant line 14.

It has to be understood that although an equal number of heat exchange tubes is shown in FIGS. 11 and 12 in each tube bank of the multi-pass heat exchanger 10, this number can be varied dependant on a relative amount of vapor and liquid refrigerant flowing through the respective tube bank. Typically, the higher vapor content in the refrigerant mixture, the more heat exchange tubes are included into a relevant refrigerant tube bank to assure appropriate pressure drop through the bank. Further, as known to a person ordinarily skilled in the art, the heat exchange tubes extending inside the manifold shouldn't create an excessive hydraulic impedance for a refrigerant flowing around the tubes inside the header, which can be easily managed by a relative header and heat exchange tube design.

It has to be noted that although the invention was described in relation to the inlet ends of the heat exchange tubes, it can also be applied to the outlet ends, although with diminished benefits of pressure drop equalization only among the heat exchange tubes in the relevant pass. Further, the breadth of the gap, G, may be varied between the heat exchange tubes or heat exchanger tube banks to further improve refrigerant distribution with typically larger gaps associated with the heat transfer tubes positioned closer to the header entrance while smaller gaps associated with the heat transfer tubes located further away from the header entrance.

Additionally, the breadth of the gap, G, may be varied along the span of an individual heat exchange tube 40, either to assure uniform distribution among the multiple channels 42 of the tube or to vary the distribution of flow among the channels 42 of the tube. Typically, gaps of larger dimensions are utilized in association with the channels 42 positioned closer to the outer edges of the heat exchange tube 40 while gaps of somewhat smaller dimensions are used in association with the channels 42 located closer towards the middle of the heat exchange tube 40. However, in some heat exchanger applications, it may be desirable to vary the gap between the leading edge and the trailing edge channels to selectively distribute the flow among the channels 42 of the heat exchange tube 40. For example, in some heat exchangers, it may be desirable for improving heat exchanger efficiency to provide a somewhat smaller gap in relationship to channels at the leading edge of the heat exchange tube, that is the edge of the tube facing into the air flow, and a somewhat larger gap in relationship to channels at the trailing edge at the heat exchange tube. By varying the breadth of the gap, G, along the span between the leading edge and the trailing edge of a heat exchange tube 40, the flow of fluid may be selectively distributed to the individual channels 42 of the heat exchange tube 40 as desired.

While the present invention has been particularly shown and described with reference to the preferred mode as illustrated in the drawing, it will be understood by one skilled in the art that various changes in detail may be effected therein without departing from the spirit and scope of the invention as defined by the claims.

We claim:

1. A heat exchanger comprising:

a header having an inside surface defining a chamber for collecting refrigerant; and at least one heat exchange tube defining a refrigerant flow path therethrough and having an inlet opening to said refrigerant flow path at an inlet end of said at least one heat exchange tube, the inlet end of said at least one heat exchange tube extending into said chamber of said header and positioned with the inlet opening to said refrigerant flow path disposed in spaced relationship with and facing the opposite inside surface of said header thereby defining a relatively narrow gap between the inlet opening to said refrigerant flow path of said heat exchange tube and the opposite inside surface of said header, wherein said gap is an expansion gap configured to expand liquid refrigerant flowing through said expansion gap to a lower pressure liquid and vapor refrigerant mixture.

2. A heat exchanger as recited in claim 1 wherein said gap has a breadth on the order of 0.1 millimeters.

3. A heat exchanger as recited in claim 1 wherein said gap has a breadth, the breadth of the gap being variable relative to the inlet end of the at least one heat exchange tube.

4. A heat exchanger as recited in claim 1 wherein said at least one heat exchange tube has a plurality of channels extending longitudinally in parallel relationship through the refrigerant flow path thereof, each of said plurality of channels defining a discrete refrigerant flow path through said at least one heat exchange tube.

5. A heat exchanger as recited in claim 4 wherein each of said plurality of channels defines a flow path having a non-circular cross-section.

6. A heat exchanger as recited in claim 5 wherein each of said plurality of channels defines a flow path has a rectangular, triangular or trapezoidal cross-section.

7. A heat exchanger as recited in claim 4 wherein each of said plurality of channels defines a flow path having a circular cross-section.

8. A heat exchanger as recited in claim 1 wherein said heat exchanger is an evaporator.

9. A heat exchanger as recited in claim 1 wherein said heat exchanger is a condenser.

10. A heat exchanger as recited in claim 1 wherein said heat exchanger is a single-pass heat exchanger.

11. A heat exchanger as recited in claim 1 wherein said heat exchanger is a multi-pass heat exchanger.

12. A heat exchanger as recited in claim 1 wherein said at least one heat exchange tube has a generally rectangular cross-section.

13. A heat exchanger as recited in claim 1 wherein said at least one heat exchange tube has a generally oval cross-section.

14. A heat exchanger comprising:

a first header and a second header, each header defining a chamber for collecting refrigerant; and a plurality of heat exchange tubes extending between said first and second headers, each of said plurality of heat exchange tubes having an inlet end opening to one of said first and second headers and an outlet end opening to the other of said first and second headers, each of said plurality of heat exchange tubes having a plurality of channels extending longitudinally in parallel relationship from the inlet end to the outlet end thereof, each of said channels having a mouth at the inlet end, each of said channels defining a discrete refrigerant flow path, the inlet end of each of said plurality of heat exchange tubes extending into said chamber of said one of said first and second headers and positioned with the inlet opening to said channels disposed in spaced relationship with and facing an opposite inside surface of said one of said first and second headers thereby defining a gap between the inlet opening to said channels and the facing opposite inside surface of said one of said first and second headers, wherein said gap is narrow relative to the flow area at each mouth.

15. A heat exchanger as recited in claim 14 wherein each gap has a breadth on the order of 0.1 millimeters.

16. A heat exchanger as recited in claim 14 wherein each gap comprises an expansion gap.

17. A heat exchanger as recited in claim 16 wherein each gap has a breadth, the breadth of the gaps being variable relative to the respective inlet ends of the plurality of heat exchange tubes.

18. A heat exchanger as recited in claim 16 wherein each gap has a breadth, the breadth of the gaps being variable relative to the respective channels of at least one of the plurality of heat exchange tubes.

19. A heat exchanger as recited in claim 14 wherein each of said plurality of channels defines a flow path having a non-circular cross-section.

20. A heat exchanger as recited in claim 14 wherein each of said plurality of channels defines a flow path having a circular cross-section.

21. A heat exchanger as recited in claim 14 wherein the plurality of heat exchange tubes have a generally rectangular cross-section.

22. A heat exchanger as recited in claim 14 wherein the plurality of heat exchange tubes have a generally oval cross-section.

23. A refrigerant vapor compression system comprising:

a compressor, a condenser and an evaporative heat exchanger connected in refrigerant flow communication whereby high pressure refrigerant vapor passes from said compressor to said condenser, high pressure refrigerant liquid passes from said condenser to said evaporative heat exchanger, and low pressure refrigerant vapor passes from said evaporative heat exchanger to said compressor;

characterized in that said evaporative heat exchanger includes:

an inlet header and an outlet header, said inlet header having an inside surface defining a chamber for receiving refrigerant from a refrigerant circuit; and at least one heat exchange tube extending between said inlet and outlet headers, said at least one heat exchange tube having an inlet end opening to said inlet header and an outlet end opening to said outlet header, said at least one heat exchange tube having a plurality of channels extending longitudinally in parallel relationship from the inlet end to the outlet end thereof, each of said channels having a mouth at the inlet end, each of said channels defining a discrete refrigerant flow path, the inlet end of said at least one heat exchange tube passing into said chamber of said inlet header and positioned with the inlet opening to said channels disposed in spaced relationship with and facing the opposite inside surface of said header thereby defining an expansion gap between the inlet opening to said channels and the facing opposite inside surface of said inlet header, wherein said gap is narrow relative to the flow area at each mouth.

24. A refrigerant vapor compression system as recited in claim 23 wherein the expansion gap has a breadth on the order of 0.1 millimeters.

25. A refrigerant vapor compression system as recited in claim 23 wherein said gap comprises an expansion gap.

26. A refrigerant vapor compression system as recited in claim 25 wherein said gap has a breadth, the breadth of the gap being variable relative to the inlet end of said at least one heat exchange tube.

27. A refrigerant vapor compression system as recited in claim 25 wherein said expansion gap is a primary expansion device in said refrigerant vapor compression system.

28. A refrigerant vapor compression system as recited in claim 25 wherein said expansion gap is a secondary expansion device in said refrigerant vapor compression system.

29. A refrigerant vapor compression system as recited in claim 23 wherein said evaporative heat exchanger is a single-pass heat exchanger.

30. A refrigerant vapor compression system as recited in claim 23 wherein said evaporative heat exchanger is a multi-pass heat exchanger.

31. A method of operating a refrigerant vapor compression cycle comprising the steps of:

providing a compressor, a condenser, and an evaporative heat exchanger connected in a refrigerant circuit;

passing high pressure refrigerant vapor from said compressor to said condenser;

passing high pressure refrigerant liquid from said condenser to an inlet header of said evaporative heat exchanger;

providing at least one heat exchange tube having a plurality of flow channels defining a plurality of refrigerant flow paths for passing refrigerant from the inlet header to an outlet header of said evaporative heat exchanger;

distributing the high pressure liquid received in the inlet header to and through each of said plurality of refrigerant flow paths by passing the high pressure liquid refrigerant through an expansion gap formed between an inside surface of the inlet header and an inlet to said at least one heat exchange tube, said expansion gap having a breadth as measured between the inside surface of the inlet header and an inlet to said at least one heat exchange tube; and passing low pressure refrigerant vapor from the outlet header of said evaporative heat exchanger back to said compressor.

32. A method as recited in claim 31 wherein said expansion gap is provided as a primary expansion device in said refrigerant vapor compression cycle.

33. A method as recited in claim 31 wherein said expansion gap is provided as a secondary expansion device in said refrigerant vapor compression cycle.

34. A method as recited in claim 31 further comprising the step of varying the breadth of said expansion gap relative to the inlet end of said at least one heat exchange tube whereby the liquid refrigerant is substantially uniformly distributed to the plurality of refrigerant flow paths of said one heat exchange tube and is expanded to a low pressure mixture of liquid refrigerant and vapor refrigerant.

35. A method as recited in claim 31 further comprising the step of varying the breadth of said expansion gap relative to the inlet end of said at least one heat exchange tube between a flow channel at the leading edge and a flow channel at the trailing edge of the heat exchange tube whereby the liquid refrigerant is selectively distributed among the plurality of refrigerant flow paths of said one heat exchange tube.

* * * * *